US010439320B2

(12) United States Patent
Goulds

(10) Patent No.: US 10,439,320 B2
(45) Date of Patent: Oct. 8, 2019

(54) ELECTRICAL CONNECTOR ARRANGEMENT

(71) Applicant: ROLLS-ROYCE plc, London (GB)

(72) Inventor: Robert Goulds, Derby (GB)

(73) Assignee: Rolls-Royce plc (GB)

( * ) Notice: Subject to any disclaimer, the term of this patent is extended or adjusted under 35 U.S.C. 154(b) by 0 days.

(21) Appl. No.: 15/912,693

(22) Filed: Mar. 6, 2018

(65) Prior Publication Data

US 2018/0254580 A1 Sep. 6, 2018

(30) Foreign Application Priority Data

Mar. 6, 2017 (GB) ..... 1703520.5

(51) Int. Cl.

| | |
|---|---|
| ***H01R 9/22*** | (2006.01) |
| ***H01R 13/533*** | (2006.01) |
| ***H01R 4/28*** | (2006.01) |
| ***H01R 9/24*** | (2006.01) |
| *H01R 4/30* | (2006.01) |
| *H01R 11/12* | (2006.01) |

(52) U.S. Cl.

CPC ..... *H01R 13/533* (2013.01); *H01R 4/28* (2013.01); *H01R 9/223* (2013.01); *H01R 9/2416* (2013.01); *H01R 4/304* (2013.01); *H01R 11/12* (2013.01)

(58) Field of Classification Search

CPC .. H01R 13/114; H01R 13/113; H01R 4/2468; H01R 4/2462

USPC ..... 439/720, 722, 723, 724, 709

See application file for complete search history.

(56) References Cited

U.S. PATENT DOCUMENTS

| | | | | |
|---|---|---|---|---|
| 3,364,078 | A | 1/1968 | Ekstrom, Jr. | |
| 8,647,159 | B2 * | 2/2014 | Steeves | H01R 4/305 439/798 |
| 9,543,669 | B2 * | 1/2017 | Broughton | H01R 4/30 |

FOREIGN PATENT DOCUMENTS

| | | |
|---|---|---|
| DE | 29701158 | 3/1997 |
| DE | 202008003294 | 3/2008 |
| WO | 2014130980 | 8/2014 |

OTHER PUBLICATIONS

Great Britain Search Report dated Aug. 16, 2017 issued in GB Patent Application No. 1703520.5.

* cited by examiner

*Primary Examiner* — Phuong K Dinh

(74) *Attorney, Agent, or Firm* — Barnes & Thornburg LLP

(57) ABSTRACT

An electrical connector arrangement comprises a metal mounting bracket for securing the arrangement to a structure; an electrically insulating mounting block abutting the mounting bracket; a clamp to secure an electrical cable to the mounting block, the electrical cable comprising a plurality of electrical conductors; and a plurality of spaced-apart terminals to accommodate the respective electrical conductors.

19 Claims, 5 Drawing Sheets

SECTION A-A

ENLARGEMENT AT B

ELECTRICAL CONNECTOR ARRANGEMENT

CROSS-REFERENCE TO RELATED APPLICATIONS

This application is based upon, and claims the benefit of priority from UK Patent Application No. GB 1703520.5, filed on Mar. 6, 2017, the entire contents of which are hereby incorporated by reference.

BACKGROUND OF THE INVENTION

Field of the Invention

The present disclosure concerns electrical connectors, and particularly electrical connectors suitable for use in high temperature environments.

Description of the Related Art

A modern gas turbine engine requires a large number of thermocouples to measure temperatures in various locations, for the purposes of engine monitoring and control. Thermocouples are electrical devices, and therefore need to be removably connected to the engine control harnesses; this is achieved by the use of connector blocks (otherwise known as disconnect terminals). This allows individual thermocouples to be removed or replaced as required. The electrical conductors of thermocouples and harnesses are commonly terminated with ring tags or similar end fittings.

The positioning of known connector blocks is limited by their temperature capability, so that when high temperatures are to be measured it is necessary to locate the connector block some distance from the measurement position. This may be detrimental to the measurement quality and also complicates removal and replacement of the thermocouples, since longer flying leads are needed, which must be routed and secured between the measurement position and the connector block.

It would be desirable to have a connector block capable of operating at high temperature, so that it can be located near to the measurement position. It would be desirable to have a connector block that facilitates easy removal and replacement of thermocouples.

BRIEF SUMMARY OF THE INVENTION

Therefore, according to a first aspect there is provided an electrical connector block comprising: a metal mounting bracket for securing the arrangement to a structure; an electrically insulating mounting block abutting the mounting bracket; a clamp to secure an electrical cable to the mounting block, the electrical cable comprising a plurality of electrical conductors; a plurality of spaced-apart terminals to accommodate the respective electrical conductors.

Each electrical conductor may comprise an end fitting which is mechanically secured to a respective terminal using a fastener. The end fitting may be a ring tag.

Each terminal may comprise a conductive sleeve. The turret may extend through a thickness of the mounting block.

The length of the sleeve may be greater than the thickness of the mounting block.

This ensures good mechanical contact, and therefore a sound electrical contact, between the electrical conductor and the conductive sleeve.

The respective sleeves of the plurality of terminals may protrude different distances from the mounting block in the thickness direction so that the terminals are offset.

This allows better access to the nuts and bolts and the possibility to tailor the pot seal so that the respective electrical conductors emerge from it in the correct positions for the offset terminals.

The fastener may be a bolt.

Each sleeve may be made from the same material as its corresponding electrical conductor.

This ensures a consistent and matching material as far as possible through the electrical connector block so that the electrical continuity and signal integrity are optimised.

The electrical cable may be a thermocouple.

The clamp may be attached to the mounting block by clamp bolts.

The mounting bracket may engage with the clamp bolts to provide electrical bonding.

The terminals may configured to prevent incorrect connection of the electrical conductors.

This reduces the risk of errors and misconnections during assembly or reassembly.

The mounting bracket may be embedded within the mounting block.

More than one clamp and more than one corresponding plurality of terminals may be provided on the mounting block.

Clamps and terminals may be provided on opposite sides of the mounting block.

The mounting block may profiled to provide recesses to accommodate the electrical cables or pot seals.

This provides more positive location for the components being mounted on the mounting block, and also provides greater protection for them by partially embedding them into the mounting block.

The mounting block may be profiled to provide turrets of differing heights to support the terminals.

This allows better access to the nuts and bolts and the possibility to tailor the pot seal so that the respective electrical conductors emerge from it in the correct positions for the offset terminals.

The mounting bracket may be embedded within the mounting block.

This may allow a more compact assembly, and may reduce weight by reducing the number of fasteners.

More than one clamp and more than one corresponding plurality of terminals may be provided on the mounting block. Clamps and terminals may be provided on opposite sides of the mounting block.

The clamps may be separately attached to the mounting block so they can be loosened and tightened independently.

The skilled person will appreciate that except where mutually exclusive, a feature described in relation to any embodiment may be applied mutatis mutandis to any other embodiment. Furthermore, any feature described herein may be combined with any other feature described herein, unless they are mutually exclusive.

BRIEF DESCRIPTION OF THE SEVERAL VIEWS OF THE DRAWINGS

Embodiments will now be described by way of example only, with reference to the Figures, in which.

DETAILED DESCRIPTION OF THE INVENTION

Figure 1:
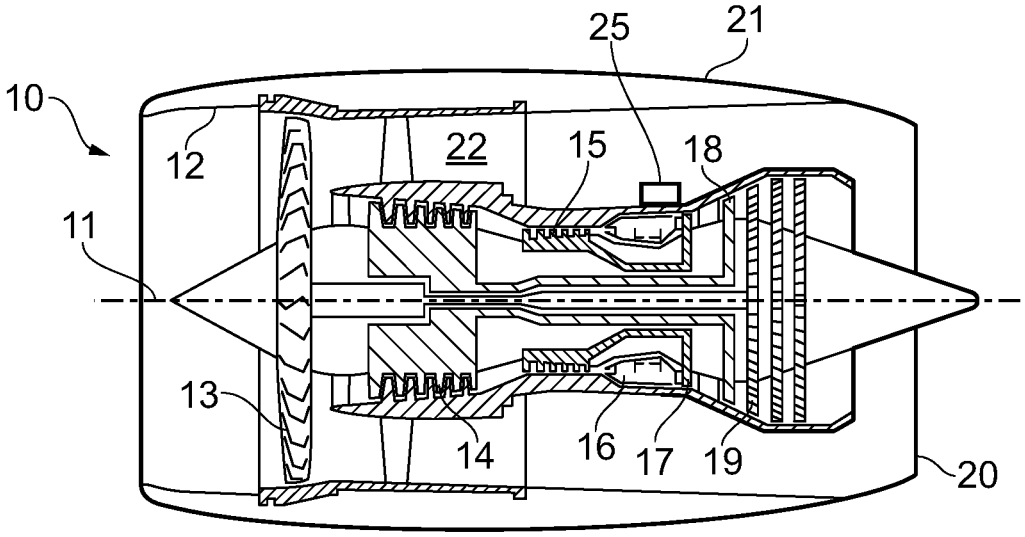
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

During the operation of the gas turbine engine, temperatures are measured at various positions in the engine for the purposes of engine monitoring and control. The thermocouples are removably connected to the engine control harnesses via connector blocks, one of which is shown schematically at 25.

Figure 2:
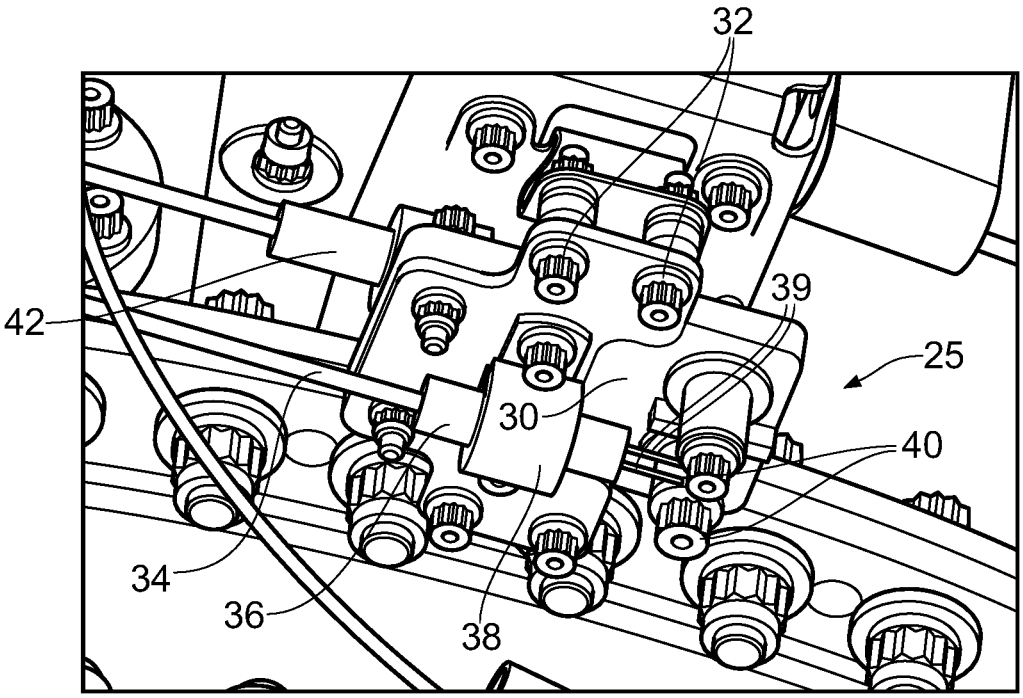
Prior Art FIG. 2
FIG. 2 shows a known electrical connector block.

FIG. 2 shows a known electrical connector block 25. The block is formed as a single monolithic piece 30, which is secured to the engine structure via bolts 32. Thermocouple 34 is terminated by a pot seal 36, which is clamped to the monolithic piece 30 by a clamp 38. The electrical conductors of the thermocouple are secured to respective terminals 40.

On the other side of the monolithic piece 30, but not visible in FIG. 2, part of the engine control harness 42 is secured to the monolithic piece 30, and the electrical conductors 39 of the thermocouple 34 are electrically connected to respective electrical conductors of the engine control harness 42 via the terminals 40.

Figure 3:
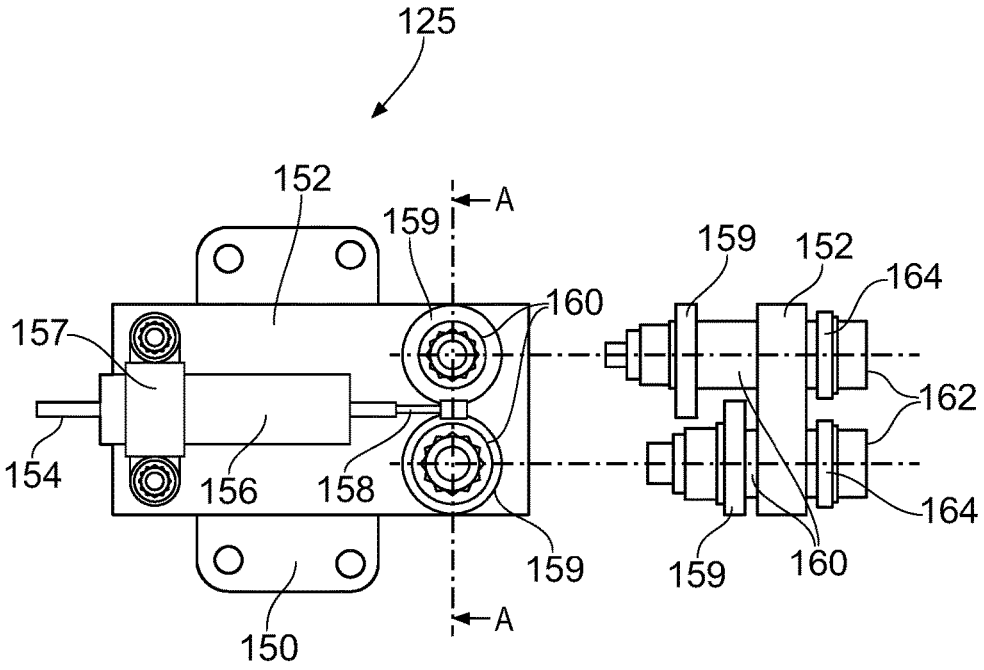
FIG. 3 shows schematic orthogonal views of an embodiment of an electrical connector block.

FIG. 3 shows schematic orthogonal views of an embodiment of an electrical connector block shown generally at 125.

The electrical connector block 125 comprises a bracket 150 which may be secured to engine structure via bolts (not shown), and an electrically insulating mounting block 152 secured to the bracket 150. In this embodiment, the bracket is made of metal, which gives it a high temperature capability; it can therefore be mounted directly to a hot casing of the gas turbine engine. The metal bracket also provides electrical bonding between the electrical connector block and the gas turbine engine casing, ensuring electromagnetic compatibility. For this purpose, the mounting bracket may in some embodiments be extended so that an electrical bonding connection can be made with the clamp or its fasteners.

The electrically insulating mounting block is made of ceramic; as well as electrical insulation this provides thermal insulation, minimising the conduction of heat from the bracket 150 and the engine structure. The provision of a separate bracket allows a single, standard design of mounting block to be used with a number of different brackets, each bracket being configured to suit the particular mounting requirements of a given location or engine.

A thermocouple 154 is terminated by a pot seal 156, which is secured to the mounting block 152 by a clamp 157. The electrical conductors 158 of the thermocouple terminate in ring tags 159. The ring tags 159 are secured to respective terminals 160 by bolts 162, which extend through a thickness of the mounting block 152. At their opposite end, the bolts 162 engage with respective ring tags 164, which terminate electrical conductors (not shown) of an engine control harness (not shown). The terminals 160 provide an electrical connection between the electrical conductors 158 of the thermocouple and the respective electrical conductors of the engine control harness. In this way, the electrical signal from the thermocouple may be transferred to engine monitoring and control systems.

Because an electrical connector block as shown in FIG. 3 can be located on the engine close to the measurement position, separate electrical connector blocks can be used for each temperature measurement that is required.

Because individual connector blocks are relatively small and compact they are easy to accommodate in whatever position is convenient. These arrangements reduce or eliminate the need for large mounting assemblies.

Figure 4:
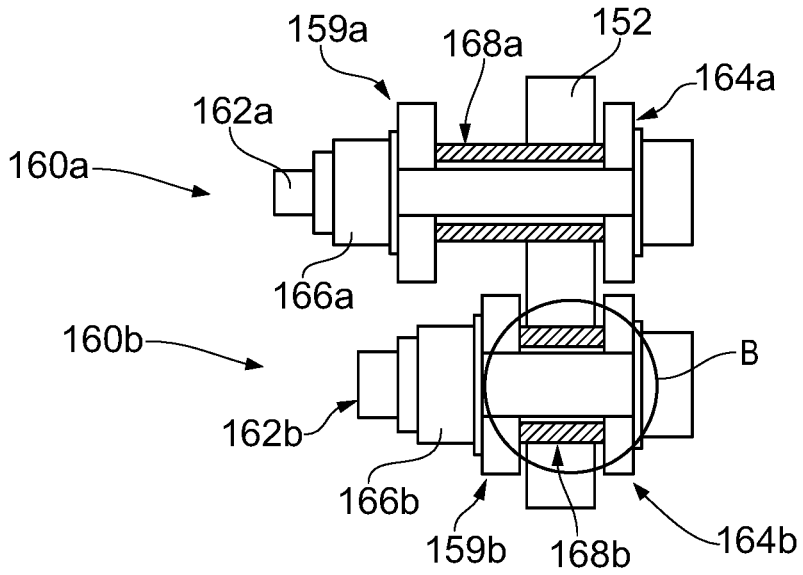
FIG. 4 is a cross-sectional view on the line A-A of FIG. 3.

FIG. 4 is a cross-sectional view on the line A-A of FIG. 3, showing more detail of the terminals 160.

Each terminal 160*a*, 160*b* comprises a bolt 162*a*, 162*b* which extends through the electrically insulating mounting block 152 and is secured by a nut 166*a*, 166*b*. Each bolt 162*a*, 162*b* and its respective nut 166*a*, 166*b* secures together a ring tag 159*a*, 159*b* terminating an electrical conductor of the thermocouple, an electrically conductive sleeve 168*a*, 168*b* and a ring tag 164*a*, 164*b* terminating an electrical conductor of the engine control harness. The electrically conductive sleeves 168*a*, 168*b* are coaxial with the bolts 162*a*, 162*b*.

As is well known, the two electrical conductors of a thermocouple are made from different metals. In this embodiment, each electrically conductive sleeve 168*a*, 168*b* is made from the same metal as the respective ring tag 159*a*, 159*b*, which in turn is made from the same metal as its respective electrical conductor. In this way, by ensuring a consistent and matching material as far as possible through the electrical connector block, the electrical continuity and signal integrity are optimised. For example, a K-type thermocouple has one chromel conductor and one alumel conductor. The ring tag and conductive sleeve for the chromel conductor would therefore be made from chromel, and the ring tag and conductive sleeve for the alumel conductor would be made from alumel.

It is envisaged that the bolts 162 and nuts 166 would be standard aerospace items, as used elsewhere on the engine. Such fasteners are readily available as spares and will therefore be more economical when replacement is required. Also, because they are made to aerospace standards their durability will be more suitable for the conditions experienced in gas turbine engines. Maintenance and repair are simplified because these standard fasteners can simply be removed and replaced without disturbing the rest of the electrical connector block.

Figure 5:
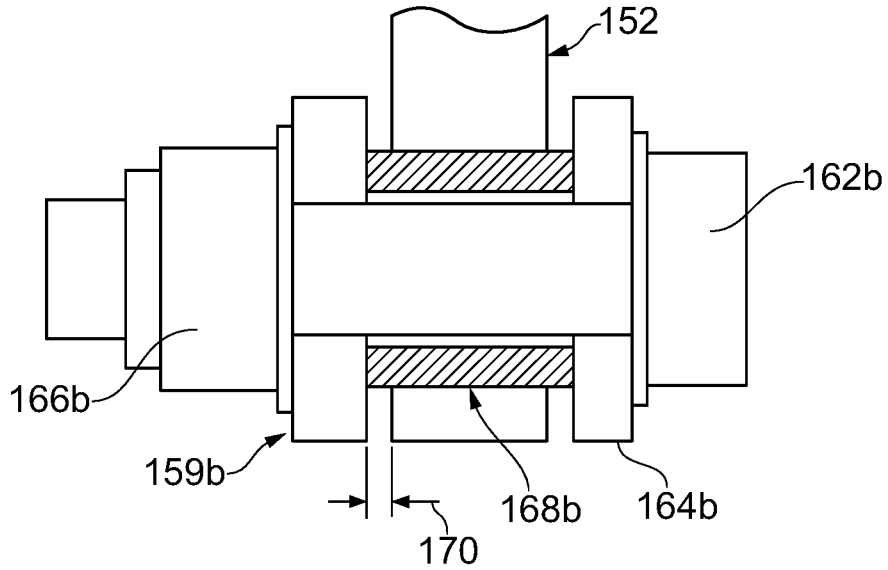
FIG. 5 is an enlarged view of the region indicated as B in FIG. 4.

FIG. 5 is an enlarged view of the region indicated as B in FIG. 4. The conductive sleeve 168*b* is longer than the thickness of the mounting block 152, so that there is a clearance 170 between the mounting block 152 and the ring tag 159*b* when the bolt 162*b* and nut 166*b* are tightened. There is a similar clearance (not labelled) on the other side of the mounting block 152, between the mounting block and the ring tag 164*b*. The lengthening of the conductive sleeve 168*b* to provide these clearances ensures good mechanical contact, and therefore a sound electrical contact, between the ring tags 159*b*, 164*b* and the conductive sleeve 168*b*.

Referring again to FIG. 4, it can be seen that the conductive sleeve 168*a* is longer than the conductive sleeve 168*b*, and the bolt 162*a* is longer than the bolt 162*b*. The effect of this is that the ring tag 159*a* sits further away from the mounting block 152 than does the ring tag 159*b*, staggering the connectors. This offers a number of advantages, including better access to the nuts and bolts and the possibility to tailor the pot seal 156 so that the respective electrical conductors emerge from it in the correct positions for the staggered connectors. Such an arrangement would help to prevent incorrect connection. It would be possible, alternatively or additionally, to make the ring tags or bolts of different shapes or sizes, so that each ring tag can only be connected to the correct terminal.

Figure 6:
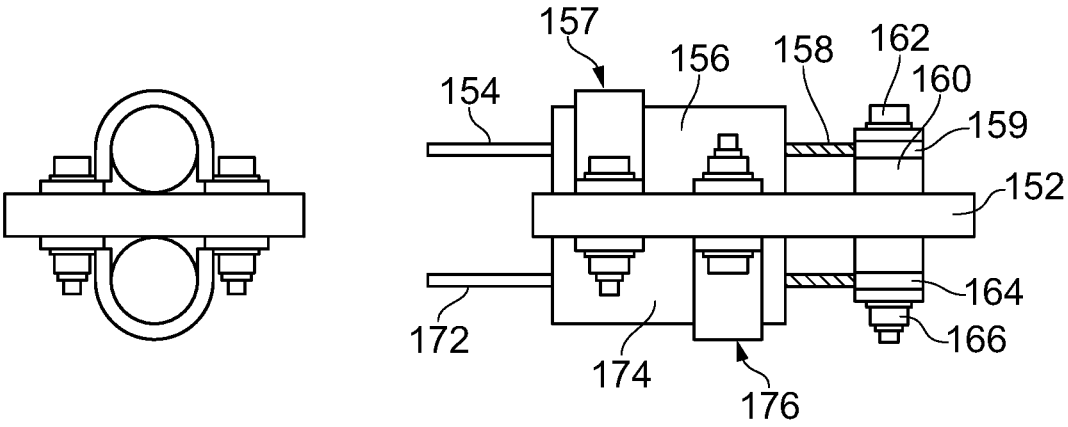
FIG. 6 shows schematic orthogonal views of a second embodiment of an electrical connector block.

FIG. 6 shows schematic orthogonal views of a second embodiment of an electrical connector block. As described above, a thermocouple 154 is terminated by a pot seal 156, which is secured to a mounting block 152 by a clamp 157. One electrical conductor 158 (only one is visible in FIG. 6) of the thermocouple is terminated by a ring tag 159. The ring tag 159 is secured to a terminal 160 by a bolt 162, which extends through a thickness of the mounting block 152.

At its opposite end, the bolt 162 engages with a ring tag 164, which terminates an electrical conductor of an engine control harness 172. The engine control harness is terminated by a pot seal 174, which is secured to the mounting block 152 by a clamp 176. Because the clamps 157, 176 are offset or staggered, one side of the termination can be disassembled while leaving the other side undisturbed and still restrained. This simplifies disassembly and reassembly and reduces the risk of unintended damage to connectors.

Figure 7:
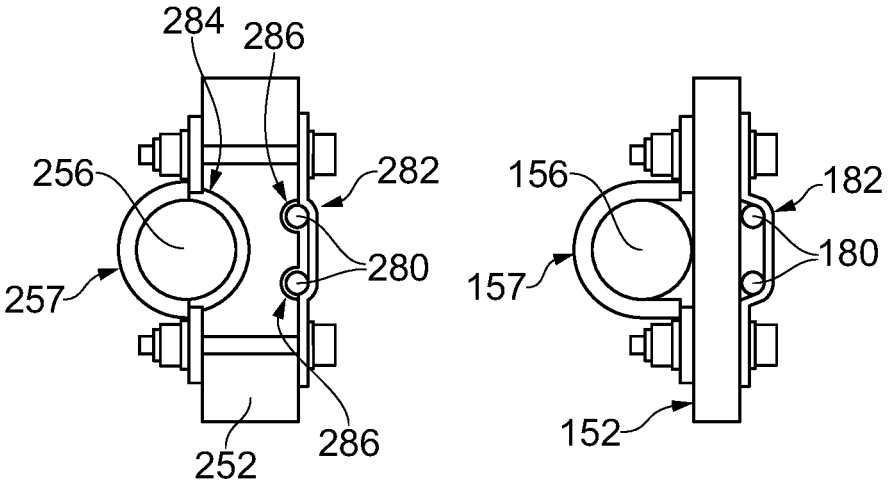
FIG. 7 shows comparative views of two alternative embodiments of an electrical connector block.

FIG. 7 shows comparative views of two alternative embodiments of an electrical connector block.

The right-hand embodiment is similar to that shown in FIGS. 3 to 6, in which the mounting block 152 has a flat rectangular shape of uniform thickness. As described above, a pot seal 156 is secured to the surface of the mounting block 152 by a clamp 157. On the opposite side of the mounting block 152, the electrical conductors of the engine control harness are not, in this embodiment, terminated by a pot seal, but are simply flexible cables 180 terminated in ring tags (not shown). The flexible cables 180 are secured to the surface of the mounting block 152 by a saddle clamp 182 of flatter design.

The left-hand embodiment shown in FIG. 7, by contrast, has a profiled mounting block 252 with a larger recess 284 on one side to accommodate a pot seal 256, and two smaller recesses 286 on its other side to accommodate flexible cables 280. As in the right-hand embodiment, the pot seal and flexible cables are secured to the mounting block 252 by clamps, respectively 257 and 282. However, in the case of the left-hand embodiment, the pot seal 256 and flexible cables 282 are now located in the respective recesses 284, 286. This provides greater protection for the pot seal 256 and flexible cables 282, and also helps to ensure their correct location on the mounting block 252 when fitting or refitting.

As shown in FIG. 7, the profiled mounting block 252 can be made thicker than the flat mounting block, yet the overall thickness of the electrical connector block including the electrical conductors is no greater. The thicker mounting block 252 does however offer advantages of greater protection and easier location, as mentioned above. Alternatively, the profiling of the mounting block with recesses 284, 286 may be used to reduce the overall thickness of the assembly.

Figure 8:
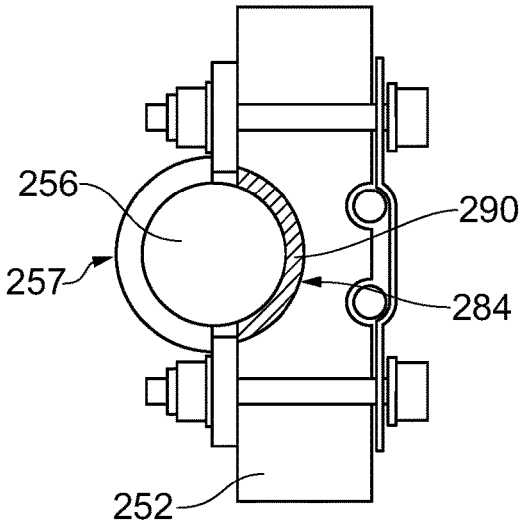
FIG. 8 shows a schematic view of a third embodiment of an electrical connector block.

FIG. 8 shows a schematic view of a third embodiment of an electrical connector block, similar to the left-hand embodiment of FIG. 7. In this embodiment, a layer 290 of padding material (of suitable temperature capability) is provided between the pot seal 256 and the recess 284, so that the pot seal 256 is clamped between the clamp 257 and the padding material 290. The padding material 290 may provide cushioning, damping or thermal insulation or a combination of these.

Figure 9:
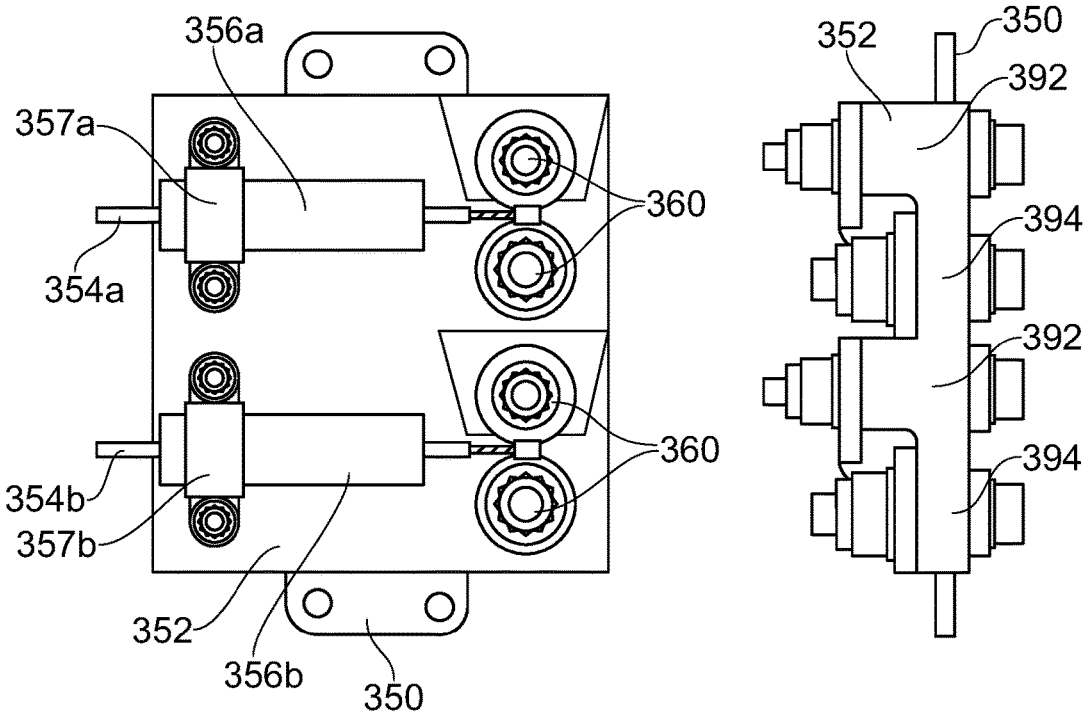
FIG. 9 shows schematic orthogonal views of a fourth embodiment of an electrical connector block.

FIG. 9 shows schematic orthogonal views of a fourth embodiment of an electrical connector block. A ceramic mounting block 352 is attached to a bracket 350, which in turn is attachable to engine structure (not shown). In this embodiment, the mounting block is configured to accommodate two thermocouples 354*a*, 354*b*, which (as described above) are terminated by pot seals 356*a*, 356*b* and secured to the mounting block 352 by clamps 357*a*, 357*b*. As in the other embodiments, the electrical conductors of the thermocouples are secured to respective terminals 360.

It will be seen from the right-hand view in FIG. 9 that the mounting block 352 is profiled to provide taller 392 and shorter 394 turrets to support the terminals 390. This provides additional support for the offset or staggered terminals described in a previous embodiment, and may also help to ensure correct connection of the electrical conductors.

Except where mutually exclusive, any of the features may be employed separately or in combination with any other features and the disclosure extends to and includes all combinations and sub-combinations of one or more features described herein.

It will also be understood that the invention is not limited to the embodiments described above and various modifications and improvements can be made without departing from the concepts described herein.

In particular, the mounting bracket may in some embodiments be embedded within the mounting block, rather than being a discrete component. Although there is some loos of modularity, this may allow a more compact arrangement and may also allow a reduction in the number of bolts or other fasteners, which may reduce the weight of the electrical connector block.

The pot seal clamps may be P-clamps or of any other suitable design, rather than the saddle clamps in the described embodiments.

As an alternative to the embodiment shown in FIG. 9, a single mounting bracket may be configured to accommodate more than one mounting block and each mounting block terminates a single thermocouple.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

The invention claimed is:

1. An electrical connector block comprising:

a metal mounting bracket for securing the arrangement to a structure;

an electrically insulating mounting block abutting the mounting bracket;

a clamp to secure an electrical cable to the mounting block, the electrical cable comprising a plurality of electrical conductors;

a plurality of spaced-apart terminals to accommodate the respective electrical conductors;

wherein each terminal comprises a conductive sleeve.

2. The connector block of claim 1, in which each electrical conductor comprises an end fitting which is mechanically secured to a respective terminal using a fastener.

3. The connector block of claim 2, in which the end fitting is a ring tag.

4. The connector block of claim 2, in which the fastener is a bolt and nut.

5. The connector block of claim 1, in which the sleeve extends through a thickness of the mounting block.

6. The connector block of claim 5, in which the length of the sleeve is greater than the thickness of the mounting block.

7. The connector block of claim 6, in which the respective sleeves of the plurality of terminals protrude different distances from the mounting block in the thickness direction so that the terminals are offset.

8. The connector block of claim 1, in which each sleeve is made from the same material as its corresponding electrical conductor.

9. The connector block of claim 1, in which the electrical cable is a thermocouple.

10. The connector block of claim 1, in which the clamp is attached to the mounting block by clamp bolts.

11. The connector block of claim 10, in which the mounting bracket engages with the clamp bolts to provide electrical bonding.

12. The connector block of claim 1, in which the terminals are configured to prevent incorrect connection of the electrical conductors.

13. The connector block of claim 1, in which the mounting block is profiled to provide recesses to accommodate the electrical cables.

14. The connector block of claim 1, in which the mounting block is profiled to provide turrets of differing heights to support the terminals.

15. The connector block of claim 1, in which the mounting bracket is embedded within the mounting block.

16. The connector block of claim 1, in which more than one clamp and more than one corresponding plurality of terminals is provided on the mounting block.

17. The connector block of claim 16, in which clamps and terminals are provided on opposite sides of the mounting block.

18. The connector block of claim 16, in which the clamps are separately attached to the mounting block so they can be loosened and tightened independently.

19. The connector block of claim 16, in which respective terminals are electrically connected so that a thermocouple can be connected via the connector block to an engine control harness.

* * * * *